US010307802B2

(12) United States Patent
Ross et al.

(10) Patent No.: US 10,307,802 B2
(45) Date of Patent: Jun. 4, 2019

(54) SAFETY WORKBENCH AND METHOD FOR THE CALIBRATION THEREOF

(75) Inventors: Gerd Ross, Frankfurt (DE); Heiko Reinhardt, Alzenau (DE); Oliver Rupp, Viernheim (DE); Stefan Brachtl, Erlensee (DE); Hermann Stahl, Nidderau (DE)

(73) Assignee: Thermo Electron LED GmbH, Langenselbold (DE)

( * ) Notice: Subject to any disclaimer, the term of this patent is extended or adjusted under 35 U.S.C. 154(b) by 1430 days.

(21) Appl. No.: 11/961,923

(22) Filed: Dec. 20, 2007

(65) Prior Publication Data

US 2008/0318509 A1 Dec. 25, 2008

(30) Foreign Application Priority Data

Dec. 21, 2006 (DE) ..... 10 2006 060 713

(51) Int. Cl.
*B08B 15/02* (2006.01)

(52) U.S. Cl.
CPC ..... *B08B 15/023* (2013.01)

(58) Field of Classification Search
CPC ..... B05B 15/1222; B08B 15/023
USPC ..... 454/56, 57, 61, 49, 370; 422/104
See application file for complete search history.

(56) References Cited

U.S. PATENT DOCUMENTS 4,466,341 A * 8/1984 Grogan ..... 454/61
4,528,898 A 7/1985 Sharp et al.
4,741,257 A * 5/1988 Wiggin et al. ..... 454/56
5,090,303 A * 2/1992 Ahmed ..... 454/58
5,092,227 A * 3/1992 Ahmed et al. ..... 454/61
(Continued)

FOREIGN PATENT DOCUMENTS

DE 44 41 784 A1 5/1996
EP 1356873 A2 10/2003
(Continued)

OTHER PUBLICATIONS

Translation of EP1609541.*

*Primary Examiner* — Steven B McAllister
*Assistant Examiner* — Ko-Wei Lin
(74) *Attorney, Agent, or Firm* — Wood Herron & Evans LLP

(57) ABSTRACT

The present invention relates to a safety workbench, in which, for the purpose of calibrating the safety workbench before beginning regular operation, a device control unit is implemented to cause measurement means to ascertain an actual measured value, which is representative of a flow velocity achieved at normal fan performance, an analysis unit is implemented to compare the actual measured value to a starting setpoint value and, in case of an established deviation, to correct a stored starting limiting value in accordance with the deviation, or means for controlling the fan are implemented to operate the fan at a fan performance corresponding to a stored starting limiting value, a device control unit is implemented to cause the measurement means to ascertain an actual limiting measured value which is representative of the flow velocity achieved at the set fan performance, and a storage unit is implemented to store the actual limiting measured value as the corrected limiting value. Furthermore, the present invention relates to a corresponding calibration method.

12 Claims, 2 Drawing Sheets

(56) References Cited

U.S. PATENT DOCUMENTS

| | | | | |
|---|---|---|---|---|
| 5,405,291 | A | 4/1995 | Alcorn et al. | |
| 5,562,537 | A | 10/1996 | Zver et al. | |
| 5,946,221 | A * | 8/1999 | Fish et al. | 700/276 |
| 6,914,532 | B2 * | 7/2005 | Crooks et al. | 340/606 |
| 7,001,263 | B2 * | 2/2006 | Shaben | 454/67 |
| 2004/0009102 | A1 | 1/2004 | Ross et al. | |
| 2007/0026786 | A1 * | 2/2007 | Liu | 454/61 |
| 2008/0113599 | A1 * | 5/2008 | Ross et al. | 454/61 |
| 2008/0318509 | A1 * | 12/2008 | Ross et al. | 454/61 |

FOREIGN PATENT DOCUMENTS

| | | | |
|---|---|---|---|
| EP | 1609541 | A2 | 12/2005 |
| WO | WO 2006002190 | A2 * | 1/2006 |

* cited by examiner

SAFETY WORKBENCH AND METHOD FOR THE CALIBRATION THEREOF

CROSS-REFERENCE TO RELATED APPLICATIONS

This application is based upon and claims the benefit of priority from prior German Patent Application No. 10 2006 060 713.9, filed Dec. 21, 2006, the entire contents of which are incorporated herein by reference.

BACKGROUND OF THE INVENTION

Safety workbenches, and particularly those for processing microbiological samples, as are described, for example, in DE 44 41 784 C2, protect from contamination by bioaerosols, which occur and are released in microbiological work. The contaminated air flow is continued as a directed air flow and conducted over filters, which hold back the contaminants from the air flow, with the aid of at least one fan within the safety workbenches.

Safety workbenches differ in their safety precautions and are constructed, tested, and licensed in accordance with the various international standards. Inter alia, safety workbenches offer personal protection or personal and product protection.

Safety workbenches which only offer personal protection are referred to as class I safety benches, the personal protection being achieved by suctioning outside air through the work opening into the working chamber of the safety workbench. As long as this outside air flow is not obstructed and sufficient air is suctioned in, particles and aerosols may not reach the outside from the inner chamber of the safety workbench. The suctioned external air thus forms an air curtain flowing through the work opening, which protects the person working at the safety workbench and/or the environment from contamination by the particles.

Adequate personal protection is a requirement for the operation of safety workbenches. This property of a safety workbench, also referred to as retention capability, is defined by a precisely established air entry velocity into the work opening, for example. It is directly proportional to the exhaust air flow, so that changes of the exhaust air flow have a direct influence on the personal protection and on the safety of the user.

Class II safety workbenches also offer, in addition to personal protection, protection to the work objects in the workbench from contamination from the outside or from contamination by other samples located in the workbench (so called cross-contamination). The protection from these types of contaminations is also referred to as product protection. The product protection results in that a part of the air flow suctioned into the workbench is fed to the inner chamber as a circulating air flow again after the filters. This circulating air flow is typically directed in a vertical falling flow from top to bottom in the working chamber of the workbench. This circulating air flow, which is also referred to as "downflow", washes around the objects located on the work plate and prevents contaminated air from the outside or from other samples from coming into contact with these objects. The circulating air flow is in turn incident in the area of the intake opening, which is usually located on the front edge of the work plate, on the outside air flow flowing into the inner chamber, so that no particles may penetrate to the outside. The product protection, including the protection from cross-contamination, is thus decisively achieved by the relationship between downflow and an air entry velocity of the outside air flow.

To generate these air flows, a normal class II safety workbench has at least one fan. Separate fans are frequently provided for the circulating air flow and the exhaust air flow, which are referred to in the following as circulating air or exhaust air fans. The air suctioned from the working inner chamber is guided via filters, such as a circulating air filter and an exhaust air filter. These filters are high-performance suspended matter filters, such as HOSCH or HEPA filters, which are capable of filtering the relevant microorganisms out of the air flow.

Adequate function of the fans thus has great significance for the safety of the safety workbench. The function of the fans is therefore typically monitored automatically during operation of the safety workbench to be able to recognize malfunctions or even breakdowns in a timely manner. For the monitoring, the volume delivered by the fan (the air quantity) per unit of time and/or the flow velocity is typically measured directly or indirectly. One possibility for this purpose is the use of a calibrated anemometer. However, it is also possible to determine, instead of the flow velocity, a value representative thereof. This may be the pressure differential which exists between the intake side of the fan and its outlet side, for example. Two barometric cells or similar devices may be used for the measurement, one of which is situated in front of and one behind the fan. A setpoint value is stored in a control and/or regulating device of the safety workbench for the selected measured variable for each of the fans. This setpoint value is permanently predefined by the producer of the safety workbench. It is used during the operation of the safety workbench as a comparison value for the safe operation of the fan. In addition, deviation margins from this setpoint value are fixed and also stored at the factory. Safe operation of the fan is assumed within these margins. Outside the range, however, adequate personal and/or product protection may no longer be ensured. In the event of deviations from this range, a visual and/or acoustic alarm is therefore typically triggered, which is to indicate the unsafe operation of the safety workbench to the user. The deviation margins are therefore frequently also referred to as alarm limits. The alarm limits are fixed by legal guidelines in some countries. Examples of safety workbenches having a safety monitoring system which monitors the operating parameters of the safety workbench during working operation are described in EP 1609541 A2 and EP 1356873 A2 of the applicant.

Setpoint values for the fans and alarm limits are measured by the producer of the safety workbench in the factory either for every workbench or representatively on one or more safety workbenches as representatives of a specific type of workbench and stored in every safety workbench. This procedure has the disadvantage, however, that the location at which the setpoint values for the fans and the alarm limits are determined and stored in the safety workbench does not correspond with the location at which the safety workbench is to be put into operation and operated further. As a function of the barometric pressure existing at the particular installation location, other values would therefore result upon renewed measurement of the setpoint values and the alarm limits than were stored in the safety workbench at the factory. Different pressure conditions may also result as a function of whether or not the safety workbench is connected to a building exhaust system. In addition, the measurement devices, such as measurement sensors, which are used for ascertaining measured values to monitor the function of the safety workbench, may display a different measurement behavior, due to mechanical strain during the transport or for other reasons, than during the measurement performed at the factory. These factors typically have the result that the measured values ascertained at the factory no longer correspond to the measured values at the operating location of the safety workbench. As a result thereof, the alarm limits set at the factory are also shifted in relation to the actually desired limiting values, so that an alarm as a result of unsafe operation of the safety workbench is triggered either too early or too late.

To prevent these false alarms, safety workbenches are often recalibrated by a service technician after being installed at the desired working location, and the setpoint values and alarm limits stored at the factory are set again by hand. However, this procedure is complex, time-consuming, and costly. In some countries, a safety workbench is required to be installed and put into operation by a service technician. However, this is not true everywhere, and safety workbenches are frequently put into operation by a service technician without further measures and recalibrations. However, if the safety workbench is then operated outside the established setpoint values and defined alarm limits, this represents a significant safety risk.

SUMMARY OF THE INVENTION

The object of the present invention is accordingly to specify a safety workbench, which operates reliably within correctly calibrated parameter ranges independently of its installation location and with which it is ensured it is correctly put into operation easily and cost-effectively even without the aid of service personnel.

In a first aspect, the present invention thus relates to a safety workbench, which may fundamentally correspond in its basic construction to a typical safety workbench. The safety workbench has a working chamber enclosed by a housing, having a work opening located in the housing front side and closable using an adjustable front pane. At least one fan is provided to deliver an air flow into the safety workbench to ensure the required personal and/or product protection. In addition, the safety workbench has a device control unit, which comprises means for controlling the at least one fan. In addition, an analysis unit and measurement means for ascertaining a measured value, which is representative of the flow velocity of the air flow achieved by the fan, are provided in the safety workbench. To ensure adequate air flow, the fan is set at the factory in such a way that during normal operation of the fan, a predefined flow velocity of the air quantity delivered by the fan is achieved. This predefined normal fan output corresponds to a starting setpoint value, which is representative of a specific flow velocity. Specifically, this starting setpoint value is thus a value predefined at the factory, which was established in consideration of the personal and/or product safety to be achieved.

This starting setpoint value, which may be stored, for example, in the storage unit of the safety workbench, does not necessarily have to specify the flow velocity directly, but rather may also be any other value which is representative of a specific flow velocity. This value may, for example, be a pressure differential which is determined in that the pressure on the inlet side of the fan and the pressure on the outlet side of the fan are measured. The pressure differential calculated from the difference of the two values may be converted into the flow velocity if desired. The corresponding pressures before and after the fan may be measured with the aid of barometric cells, for example. If the flow velocity is measured directly, an anemometer may be used as the measurement means for this purpose. The starting setpoint value also does not necessarily have to be a variable directly measurable using the measurement means. For example, the starting setpoint value may be provided in the form of a specific fan performance—such as a specific speed or a specific power consumption—which in turn results in a specific flow velocity of the air flow delivered by the fan, however. It is typical, for example, to fix the normal fan performance as a fraction of the maximum possible fan performance. In each case, the starting setpoint value relates to a value predefined at the producer for the normal operation of the fan, however, which is to simulate optimal operation of the safety workbench while maintaining the personal and/or product protection, but does not consider the ambient conditions at the working location of the safety workbench.

In addition to the starting setpoint value, at least one limiting value is also stored in the storage unit of the safety workbench, which deviates by a predefined amount from the setpoint value. This permissible deviation no longer corresponds to optimal operation of the safety workbench and optimal performance of the fan, but defines an operating range which is still permissible, in which sufficient personal and/or product protection is still ensured. This limiting value corresponds, for example, to an alarm limit described at the beginning. For example, the delivery performance of the fan may be reduced in the course of the operating time by wear. The reduced delivery quantity per unit of time thus caused and the correspondingly reduced flow velocity do not yet have to result in a user no longer being protected adequately from contamination or cross-contamination occurring inside the working chamber. A further factor which may have a disadvantageous effect on the delivery quantity of the fan and the flow velocity is, for example, the increasing clogging of the filter by particles accumulated thereon. This also results in the protection of user and products from contamination no longer being ensured only in the course of time, however.

To take these factors into consideration, deviations from the starting setpoint value are provided at the producer for an optimal fan performance and/or flow velocity. For this purpose, at least one limiting value is stored in the storage unit of the safety workbench. This may solely be a single limiting value for a specific starting setpoint value, which permits a specific reduction of the flow velocity, for example. Typically, however, one limiting value for a deviation upward from the setpoint value and one limiting value for a deviation downward are defined per setpoint value, so that a deviation range is fixed around the setpoint value. If multiple fans are used per safety workbench, there is typically a setpoint value for each of the fans and correspondingly also at least one starting limiting value for each setpoint value.

The starting limiting values, also referred to as alarm limits, may also be fixed in various ways. For example, they may be values related to the fan performance. It is also possible to fix the alarm limits directly as flow velocities. As already noted multiple times, these do not have to be values of the flow velocities per se, but rather may also be values which allow conclusions about a specific flow velocity. Concretely, for example, this may be a pressure differential ascertained over the corresponding fan. When the starting limiting values for the still permissible flow velocities are fixed, flow velocities may already be measured at the producer of the safety workbench for fixed fan performances and the ascertained values may be stored in the storage unit of the safety workbench. Measurements are expediently performed at the normal operating performance of the fan, a reduced operating performance of the fan, which corresponds to a fan performance just still permissible and thus to a lower alarm limit, and possibly an upper alarm limit, i.e., a maximum fan performance still just permissible for safe operation, but exceeding the normal fan performance. The flow velocities ascertained for the particular fan performances thus correspond to the flow velocity for the normal operation of the fan, the flow velocity at the lower alarm limit, and the flow velocity at the upper alarm limit, in each case for the ambient conditions at the measurement location, i.e., typically in the factory of the producer.

The starting limiting value may be the same type of values as for the starting setpoint value. Thus, these may be values directly measurable using the measurement means of the safety workbench, such as a flow velocity or pressure differential, or they may be values not directly measurable using the measurement means, such as the fan performance. Again, the at least one starting limiting value is a value predefined at the producer, which is representative of a flow velocity for an operation deviating from normal operation of the fan, but does not yet consider the ambient conditions at the working location of the safety workbench.

The measurement means for determining starting setpoint value and starting limiting value(s), such as anemometer or barometric cell, are fundamentally known devices which have already been installed in safety workbenches up to this point. These measurement means typically contribute in typical safety workbenches to monitoring the operation of the fans during the typical operation of the safety workbench. A corresponding safety workbench is described, for example, in EP 1609541 A2 of the applicant. However, in the present invention, the measurement means are used for the purpose of automatically recalibrating the predefined setpoint and limiting values in consideration of the altered ambient conditions. This does not preclude the measurement means, during the regular operation of the safety workbench after completion of the calibration, from also being used for monitoring the device parameters during operation.

The way in which the calibration is performed is decisively a function of how the starting setpoint and limiting values are predefined. If these are values not directly measurable using the measurement means, which define the flow velocity via the fan performance, for example, the fan performance is set for the calibration and a measurable value is measured for this fan performance and stored as a corrected value, which takes the ambient conditions of the working location into consideration. Limiting values stored directly as measurable values may also be corrected by computer, without a measurement at the working location having to be performed for each of the stored values.

Correspondingly, in variant A), the calibration is performed in that initially a correction of the starting setpoint value is performed for the at least one fan of the safety workbench. For this purpose, the device control unit activates this fan in such a way that it delivers air through the safety workbench for a time at normal performance. Normal performance of the fan is to be understood here as the performance at which the fan works during normal operation of the safety workbench. This is the delivery performance of the fan, which is predefined at the factory and corresponds to the starting setpoint value stored in the storage unit. If the safety workbench was thus operated under exactly the same conditions as during fixing of the starting setpoint value, the starting setpoint value must also result at the new installation location of the safety workbench as the actual measured value ascertained by the measurement means.

However, the actual measured value ascertained by the measurement means during the calibration procedure will typically deviate from the starting setpoint value stored in the memory unit. This may be, as noted at the beginning, because of a barometric pressure changed in relation to the production location of the safety workbench or because of a changed measurement behavior of the measuring means used, for example. The actual measured value actually ascertained by the measuring means at normal performance of the fan is compared in the analysis unit of the safety workbench to the starting setpoint value stored in the storage unit. If a deviation between actual measured value and starting setpoint value is established, the at least one starting limiting value, which is related to the starting setpoint value and also stored in the storage unit, is corrected in accordance with the established deviation between actual measured value and starting setpoint value. The at least one corrected limiting value thus obtained is stored in the storage unit.

To be able to perform a comparison between starting setpoint value and actual measured value, similar values are expediently used. For example, pressure differential values are thus used in both cases. Theoretically, it would also be conceivable to use values which are not directly comparable and to convert one value to the unit of the other value before the comparison. However, this is not preferable because of the greater complexity. The at least one starting limiting value stored in the storage unit is expediently also directly comparable to starting limiting value and actual measured value, so that a correction may be performed directly.

The deviation between actual measured value and starting setpoint value is expediently calculated as a difference. Correspondingly, the at least one starting limiting value is either increased or reduced by the same amount. For example, if the flow velocity at normal fan performance at the operating location is less than the stored starting setpoint value for this operating state by the value x, the value x is subtracted from the starting limiting value. The at least one corrected limiting value may fundamentally be used further in the way in which it was obtained from the correction calculation in the regular operation of the safety workbench following the calibration. For example, the corrected limiting value may be stored directly as the value which represents a specific flow velocity. This may either be a flow velocity value directly or a value correlating with this value, such as the already mentioned pressure differential over the fan. The corrected limiting value thus obtained may then be used as such or as one of the alarm limits, upon exceeding which safe operation of the safety workbench is no longer ensured. This corrected limiting value thus directly replaces the limiting value stored in the storage unit at the factory for fixing an alarm limit.

However, the at least one limiting value may also be stored in the storage unit of the safety workbench in a form in which it does not directly correspond to a variable measurable by the measuring means. For example, the at least one limiting value may be fixed as a percent deviation from the normal fan performance correlating with the starting setpoint value. Concretely, for example, limiting values of ±20% in relation to the normal fan performance may be stored as the alarm limits in the storage unit. A specification which relates to a fraction of the maximum possible fan performance is also possible. The starting limiting values may then correspond, for example, to specific fan speeds or a specific power consumption of the fan.

These starting limiting values do not provide limiting values which may be remeasured and checked directly as alarm limits during the normal operation of the safety workbench. Correspondingly, they also may not—as in variant A)—be corrected directly. Correspondingly, in variant B), an actual limiting measured value corresponding to the starting limiting value is therefore ascertained, which is representative of a flow velocity achieved by the fan at the measuring instant and thus takes the ambient conditions of the safety workbench at the installation location into consideration. The difference from variant A), in which an actual measured value is ascertained for the normal operation of the fan, is thus that in B), a measured value is ascertained which corresponds to a fan performance outside the normal operation, namely at the at least one starting limiting value. Therefore, variant A) may be referred to as "normal operation correction" and variant B) as "limiting operation correction".

Concretely, in variant B), the fan is thus first reduced to a performance which corresponds to a fan performance fixed by a stored starting limiting value. This may be a percent component of the maximum fan performance, for example. A value representative of the flow velocity is now determined for this reduced fan performance. The value thus obtained, whether it is the flow velocity directly or another measured value representative of the flow velocity, is stored in the storage unit. This corrected limiting value may be used in normal operation of the safety workbench as a comparison value, to which the flow velocity measured during the current operation (or again a corresponding value) is compared. If the actually measured flow velocity deviates over the flow velocity fixed for the alarm limit out of the range fixed for safe operation, an alarm is triggered, for example.

In variant B), it is not absolutely necessary to perform a "normal operation correction", i.e., a correction of the starting setpoint value, if the alarm limits are fixed by an upper and a lower limiting value and not by a flow velocity value at normal fan performance. It is also possible in such a case, however, and generally advisable to perform a correction of the starting setpoint value and to determine an actual measured value for the normal fan performance as was described in step A1).

Through the procedure described, at least one corrected limiting value for a fan is now stored in the storage unit of the safety workbench, which takes the changed ambient conditions of the safety workbench into consideration. If multiple starting limiting values are defined for a starting setpoint value stored in the storage unit, the stored starting limiting values are corrected for all of these values.

If the safety workbench has more than one fan, the steps described above are executed separately and in sequence for each of the fans, until corrected values are provided for each of the fans. The various fans may, for example, be an exhaust air fan and a circulating air fan, as have also been used up to this point in safety workbenches of the prior art. The exhaust air fan conveys a part of the air flow out of the safety workbench and feeds it back to the outside air after it has passed through a filter. Because the exhaust air volume is proportional to the intake volume, the exhaust air fan also determines the air flow which comes into the safety workbench through the work opening. The exhaust air fan is thus primarily responsible for the personal protection and the protection of the surroundings of the safety workbench from contamination. An air flow is guided from top to bottom in the working chamber inside the workbench using the circulating air fan. This so-called downflow washes around the objects located on the work plate and is thus primarily used for product protection and to prevent cross-contamination. Typically, approximately 70% of the total air flow suctioned out of the working inner chamber is guided back into the working inner chamber as the circulating air flow, while the remaining approximately 30% is discharged to the room air and/or to the exhaust air systems leading out of the room as the exhaust air flow. Corresponding to the different functions of the fans, both different fan performances for normal operation and corresponding different starting setpoint values may be predefined, and also different alarm limits. For example, the alarm limits for the exhaust air fan may be drawn more narrowly than those for the circulating air fan, because the protection of the user in the surroundings of the safety workbench fundamentally receives a higher priority than the protection of the products inside the safety workbench. For example, deviations of ±20% of the fan performance in normal operation may be provided for the circulating air fan, while only deviation limits of ±10% are permitted for the exhaust air fan. Frequently, only a lower alarm limit for a reduced fan performance is also provided for the exhaust air fan, while higher performances are seen as harmless. In some countries, the alarm limits are also legally prescribed and are then set in accordance with this prescription.

The calibration routine according to the present invention is expediently performed before the safety workbench is put into operation for the first time at a new installation location. The calibration method may be started manually, for example. Preferably, however, the method is started automatically, which is particularly advisable if the safety workbench is put into operation without service personnel. An inquiry, which is stored in the software of the device control unit, is expediently run through before beginning the calibration method for this purpose.

The inquiry checks whether a calibration method has already been performed for the safety workbench. For this purpose, information as to whether or not this is the case is stored at the factory in the software. For example, there is a switch in the software which is set to 0 at the factory. 0 means that up to this point no calibration has been performed. As soon as the safety workbench is supplied with voltage for the first time, the device control unit starts the inquiry program, which in turn starts the calibration procedure if it is established that the switch in the software is set to 0. After running through the calibration method, the switch in the software is set to 1, so that calibration is no longer performed the next time the safety workbench is turned on.

In addition to the calibration when the safety workbench is first put into operation, it may also be advisable to perform the calibration procedure again after a long operating time of the safety workbench. For example, a renewed calibration of the fan is advisable after a filter change or after other repairs which influence the fan performance or the flow velocity. To start a renewed calibration, the switch in the software of the safety workbench may be reset by a service technician from 1 to 0. When the safety workbench is turned on again, the calibration method starts again after the inquiry in the software has shown that a calibration is to be started.

To avoid faulty calibrations, it is preferable to check before establishing corrected limiting values whether the fan to be calibrated operates at an acceptable performance at all or if there are other flaws in the safety workbench. The fan may have been damaged during the transport, for example, and only still have an inadequate delivery performance. To preclude this, for example, it may be checked before beginning the calibration whether the fan performance is in order.

Concretely, for example, it is checked whether the power consumption and/or the speed of the fan lie in a predefined setpoint value range. Additionally or alternatively thereto, it may be checked whether the flow velocity measured at the beginning of the calibration procedure, which the fan achieves, deviates by more than a previously defined deviation range, which is stored in the storage unit, from the starting setpoint value stored and saved at the factory. Unacceptable deviations of this type may not only be caused by damage to the fan, but rather also may originate from transport covers of filter units, ventilation openings, or similar features in the safety workbench not having been removed before being put into operation, for example, and thus obstructing the air flow inside the safety workbench. To prevent a calibration from being performed in such a flawed state of the safety workbench, the fan performance and the achieved flow velocity are expediently previously checked. If an unacceptable deviation from the predefined values is established, either the calibration procedure may be aborted immediately, or the calibration procedure is started again at least one further time to check whether the reason for the error has been removed in the meantime. If this is not the case even after a defined number of new attempts, the calibration procedure is aborted. After abortion of the calibration routine, a corresponding error message may be output on a display of the safety workbench, for example.

After completing calibration, it is ensured that the safety workbench also operates on the basis of device parameters and alarm limits exactly tuned to the working location at its new working location. In addition, a service technician may be dispensed with when putting the safety workbench into operation. However, if a service technician is present when putting it into operation, his work is correspondingly made easier and the time expenditure is significantly reduced. Depending on the way in which the calibration is executed, work may also be saved at the factory, because all parameter values no longer have to be measured and stored already at the factory. For example, the flow velocities corresponding to the alarm limits may also be measured for the first time by the user of the safety workbench at the working location.

BRIEF DESCRIPTION OF THE DRAWINGS

The present invention will be explained in greater detail in the following on the basis of drawings. These drawings are solely schematic and are only used to explain a preferred exemplary embodiment of the present invention, without the present invention being restricted to this example. In the drawings.

DETAILED DESCRIPTION

Figure 1:
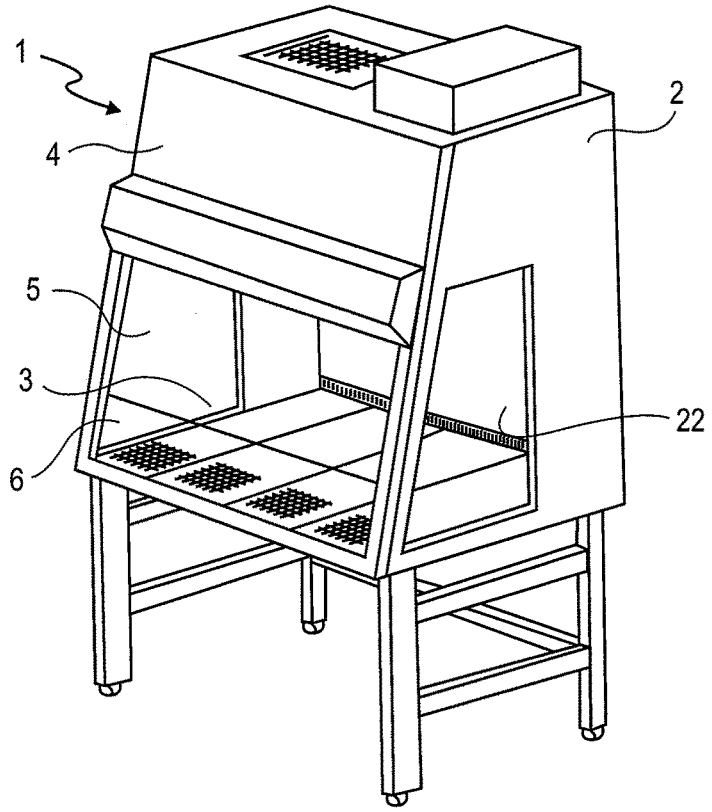
FIG. 1 schematically shows a safety workbench according to the present invention in a perspective view.
Figure 2:
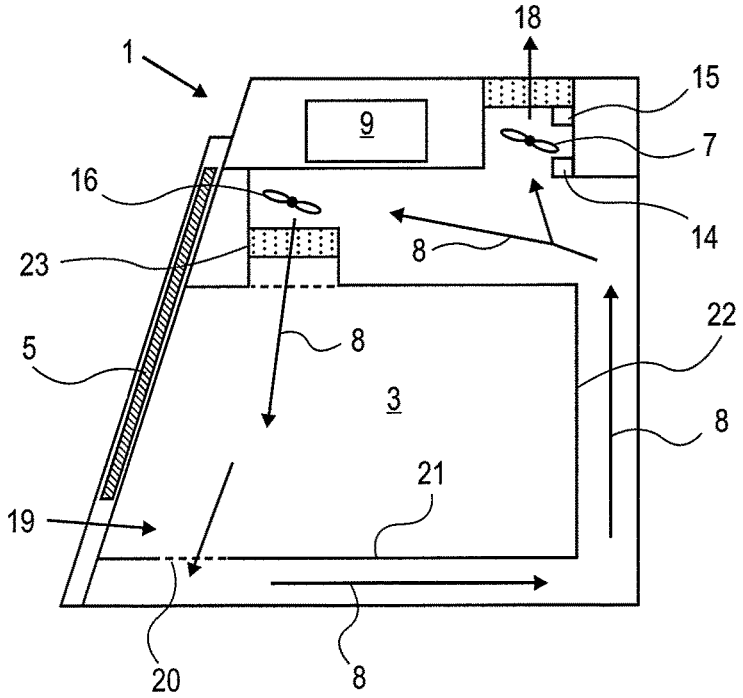
FIG. 2 schematically shows a cross-section through the safety workbench according to the present invention shown in FIG. 1, and FIG. 3 schematically shows a circuit diagram of the device control unit of the safety workbench according to the present invention for performing a calibration method.

FIGS. 1 and 2 show a safety workbench (1) according to the present invention, which may be used for processing microbiological cultures, for example. In its basic construction, the safety workbench (1) corresponds to that known from the prior art. The safety workbench has a housing (2), which encloses a working inner chamber (3). An adjustable front pane (5) is situated on the housing front side (4), which is mounted in such a way that it may be pushed up and down essentially parallel to the housing front side. By pushing down the front pane (5), the work opening (6) located on the housing front side may be made smaller or closed entirely. The height of the work opening (6) thus results from the gap between the bottom side of the front pane (5) and the working chamber floor plate of the housing (2).

Two fans are provided in the safety workbench (1), namely an exhaust air fan (7), which conveys a specific volume component of the air (8) delivered into the interior of the safety workbench (1) out of the safety workbench as an exhaust air flow (18). The exhausted exhaust air (18) is replaced by outside air (19), which flows in through the work opening (6) into the working inner chamber (3) of the safety workbench (1).

In the interior of the safety workbench, the air flow (8) is delivered by a circulating air fan (16), which conducts transported air through an opening (20) in the work plate (21) and through channels, which are located in an area below the work plate (21) and behind the rear wall (22) delimiting the working inner chamber (3), via a filter (23) from top to bottom in the direction toward the work plate (21).

In order that a sufficient personal and/or product protection is ensured in the safety workbench, circulating air and exhaust air must be conveyed by the corresponding fans at the predefined flow velocity through the safety workbench. Because the flow velocities of the circulating air and exhaust air are also a function of the ambient conditions such as the air pressure, for example, it must be ensured that the flow velocities are in the predefined velocity ranges independently of the installation location of the safety workbench (1). Correspondingly, these limiting values must be set again at the installation location of the safety workbench. In the safety workbench according to the present invention, this is performed using an automatic calibration method. The sequence is to be explained in greater detail in the following for exemplary purposes on the basis of FIG. 3.

The calibration method is only shown here for the exhaust air fan (7). A corresponding calibration procedure may be performed for the circulating air fan (16) before the calibration procedure for the exhaust air fan (7) or subsequently thereto. The procedure of the first calibration after the installation of the safety workbench at its new working location is described here. The calibration method is executed by the device control unit (9), which may be a control unit already typically present in a safety workbench.

As soon as the safety workbench (1) is connected to the local power network and impinged with voltage for the first time, an inquiry starts in a processor (not shown in greater detail) of the device control unit (9), which checks whether a calibration method as already been performed for the safety workbench. The response to this inquiry is coded in a software switch, which is set to 0 at the factory, which states that in this case no calibration has yet occurred.

Because of the obtained response, the calibration routine is started by the device control unit (9). The fan is started in a first step by means (10), integrated in the device control unit (9), for controlling the fan (7) and caused to run at a fan performance predefined for the normal operation of the safety workbench. For example, the normal fan performance is set to 70% of the maximum possible fan performance. After a predefined time has passed since the starting of the fan (7), it is ascertained with the aid of the measurement means at which flow velocity the fan (7) delivers air through the inner chamber of the safety workbench.

The flow velocity of the air quantity delivered by the fan (7) is determined in that a pressure differential which builds up via the fan (7) is measured. To measure this pressure differential, a barometric cell (14) and (15) is situated in each case upstream from the fan (7) and downstream therefrom. Barometric cell (14) measures the pressure upstream from the fan (7), and barometric cell (15) measures the pressure downstream from the fan. Both barometric cells are situated at a small distance to the fan (7). The ascertained pressure values are transmitted by the barometric cells (14) and (15) to an analysis unit (12), which is situated in the device control unit (9). A pressure differential, which is output to the storage unit (11) and stored therein, is calculated in the analysis unit (10) from the ascertained values.

In a next step, the means (10) for controlling the fan (7) activate it in such a way that the fan (7) runs at a performance which corresponds to the predefined lower limiting value of the fan performance, i.e., the lower alarm limit. The lower alarm limit may be fixed at a fan performance of 60% of the maximum possible fan performance, for example. The fan performance at the lower alarm limit is thus 10% less than during normal operation of the fan. After the fan (7) has run for a time at 60% of the maximum possible performance, pressure values are measured again by the barometric cells (14) and (15), and the ascertained measured variables are transmitted to the analysis unit (12). A pressure differential is again calculated from the two values therein. This pressure differential is representative of the still just permissible lower flow velocity of the fan (7). This value is stored as the new lower alarm limit in the storage unit (12).

If an upper limiting value corresponding to an upper alarm limit for the fan performance is also stored for the fan (7), this upper alarm limit is now approached by the fan. For example, the maximum permissible performance of the fan may be fixed at 80% of the maximum fan performance. The maximum permissible fan performance is thus 10% more than the normal performance of the fan. The means (10) for controlling the fan (7) correspondingly now activate the fan (7) for the correction of the upper alarm limit in such a way that it is operated at 80% of its maximum performance. After passage of a predefined time period, pressure values are again measured using the barometric cells (14) and (15), these values are subtracted from one another in the analysis unit (12) to provide the pressure differential over the fan (7), and the calculated value is stored as the upper alarm limit in the storage unit (11).

After corrected flow velocities in the form of pressure differential values have been obtained both for the normal operation of the fan and also for the alarm limits, within which safe operation of the safety workbench is still just ensured, the calibration method is terminated. The switch originally set to 0 in the software is now automatically set to 1, so that the calibration method is not started once again unintentionally. The device control unit (9) now changes the device parameters over to normal operation. One may work in the safety workbench (1) in the typical way. It is ensured that the fixed alarm limits are set correctly corresponding to the surrounding parameters of the safety workbench. Thus, unintended false alarms are not triggered, although the safety workbench is actually still in safe operation, and vice versa, triggering an alarm is not missed because of incorrectly set alarm limits, although the safety workbench already no longer operates at adequate flow velocities.

A safety monitoring system (17) is integrated in the device control unit (9) to monitor the safety workbench. During normal operation of the safety workbench (1), flow velocity measurements are performed continuously or at fixed intervals. This is performed here, as already during the calibration method, by ascertaining pressure differential values for the fans (7) and (16). The current pressure differential data ascertained during the operation is compared to the values corrected by the calibration method. If a measured value ascertained for one of the fans deviates out of the permissible area defined by the corresponding alarm limits, a visual or acoustic alarm is triggered by the safety monitoring system (17). The alarm device (24) outputs an alarm signal.

Figure 3:
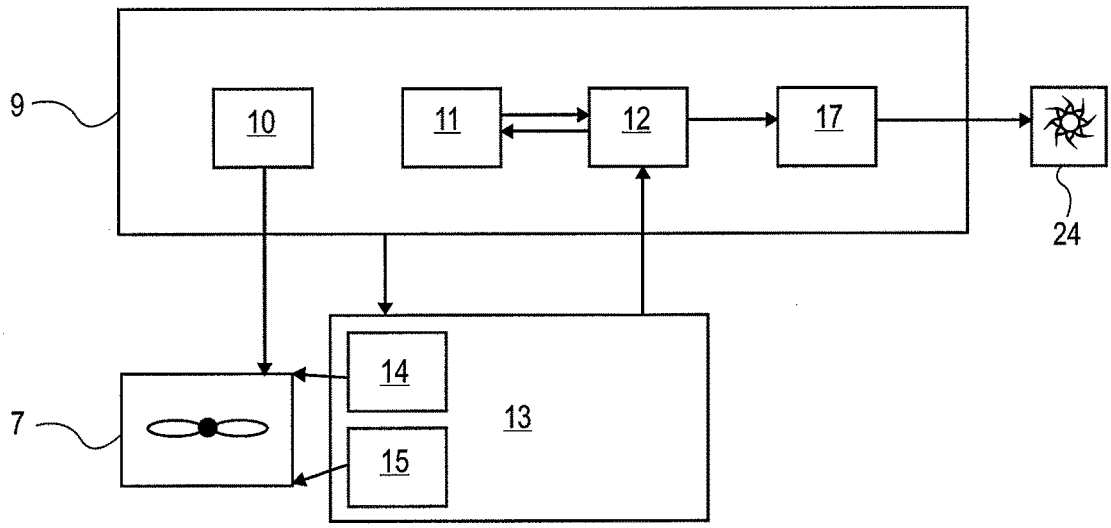

In FIG. 3, the means (10) for controlling the fan (7), the storage unit (11), the analysis unit (12), and the safety monitoring system (17) are all integrated in the device control unit (9). However, this is solely exemplary. The individual components may also be installed spatially separate from one another in the safety workbench (1). It is also possible that various control, analysis, or storage functions are assumed by the same device, although separate components are shown for this purpose here. Typically, the required means are already present in any case in typical systems of safety workbenches, so that no additional components are needed but rather these systems must solely obtain additional functionalities.

Finally, a simplified variant of the calibration method described above is to be presented, which may also be performed using the control unit schematically illustrated in FIG. 3. The first steps of the calibration method are identical to the preceding method. Up to ascertaining a pressure differential for the fan at normal fan performance (i.e., 70% of the maximum fan performance here), the calibration methods correspond. A pressure differential is thus obtained from the measurement procedure at normal fan performance, which corresponds to a flow velocity at the installation location of the safety workbench. This pressure differential value is now compared in the analysis unit (12) to a pressure differential value for the fan at normal performance stored in the storage unit (11), which corresponds to the fan performance at the production location of the safety workbench. For example, the pressure differential for the fan (7) at the production location of the safety workbench was 50 Pa. The pressure differential for the fan in normal operation measured at the working location of the safety workbench during the calibration procedure was 40 Pa, for example. The difference between both pressure differential values is now ascertained in the analysis unit (12). 50 Pa−40 Pa=10 Pa results. This value is stored in the storage unit (11). Moreover, pressure differential values for the fan (7), which were ascertained at the production location for the fan (7) at the upper and lower alarm limits, are stored in the storage unit (11). For example, a pressure differential of 35 Pa was ascertained for the fan (7) at reduced performance, which corresponds to the lower alarm limit. The ascertained differential value of 10 Pa is now subtracted from this value. A corrected pressure differential value for the lower alarm limit of the fan (7) at the current installation location of 25 Pa thus results. This ascertained corrected pressure differential value for the lower alarm limit is stored in the storage unit (11) and used as the newer lower alarm limit for the safety monitoring by the safety monitoring unit (17) during the regular operation of the safety workbench. The same procedure is used for the upper alarm limit. The pressure differential value stored at the factory for the upper alarm limit is thus corrected downward by 10 Pa, stored, and used as a new limiting value (upper alarm limit) in the safety monitoring of the safety workbench during regular operation. In this calibration method variant, the upper and lower alarm limits are thus no longer actively approached and measured again, but rather only one measurement is still performed at normal fan performance and a correction of the upper and lower alarm limits is performed on the basis of the ascertained deviation. The termination of the calibration method again corresponds to the method described at the beginning.

The described calibration method may not only be started automatically when the safety workbench is first put into operation. It is also possible and advisable to perform further calibrations of the alarm limits when repair work has been executed on the safety workbench. This is true in particular for repair work which may influence the flow velocity inside the safety workbench. The replacement of filters, and the replacement or repair of fans may be cited here as examples. To start the calibration procedure, the switch set in the software, which is set to 1 after the safety workbench is put into operation and calibrated for the first time, is reset back to 0, so that the calibration routine may start. Of course, it is also fundamentally possible that the calibration routine does not start automatically, but rather must always be started manually. If desired, authorizations may be given out for this purpose, so that only authorized individuals may perform a calibration.

What is claimed is:

1. A safety workbench having:

a working chamber, enclosed by a housing, having a work opening located in the housing front side and settable using an adjustable front pane, at least one fan for delivering an air flow into the safety workbench, a device control unit, comprising a fan control configured to control the at least one fan, a storage unit configured to store at least one starting limiting value comprising at least one of a lower alarm limit and/or an upper alarm limit as at least one stored starting limiting value, which deviates by a predefined amount from a starting setpoint value, which corresponds to a specific flow velocity of the air flow delivered by the at least one fan at a predefined normal fan performance, an analysis unit, and at least one measurement device configured to ascertain a measured value, which is representative of the flow velocity of the air flow delivered by the at least one fan, wherein for the purpose of calibrating the safety workbench, (i) the device control unit is implemented to cause the measurement device to ascertain an actual measured value, which is representative of a flow velocity achieved at a measuring instant by the at least one fan set to operate at the starting setpoint value, the analysis unit is implemented to compare the actual measured value to the starting setpoint value and, in case of an established deviation between the actual measured value and starting setpoint value, to correct the at least one stored starting limiting value in accordance with the established deviation, and the storage unit is implemented to store the at least one corrected starting limiting value ascertained by the analysis unit, or (ii) the fan control the at least one fan is implemented to operate the at least one fan at a fan performance corresponding to the stored starting limiting value, the device control unit is implemented to cause the at least one measurement device to ascertain an actual limiting measured value, which is representative of a flow velocity achieved at a measuring instant by the at least one fan at the fan performance set, and the storage unit is implemented to store the ascertained actual limiting measured value as the corrected starting limiting value.

2. The safety workbench according to claim 1, wherein the normal fan performance is a fraction of the maximum fan performance.

3. The safety workbench according to claim 1, wherein the at least one measurement device is implemented to measure the flow velocity directly, and is an anemometer or is implemented to ascertain a pressure differential over the at least one fan.

4. The safety workbench according to claim 1, wherein a starting measured value obtained at a fan performance not corresponding to the normal fan performance, which is representative of a flow velocity achieved by the at least one fan, is stored as the starting limiting value in the storage unit.

5. The safety workbench according to claim 4, wherein the device control unit is implemented to cause the at least one measurement device to ascertain the actual measured value which is comparable to the starting setpoint value and the starting measured value stored as the at least one starting limiting value.

6. The safety workbench according to claim 1, wherein the analysis unit is implemented to calculate a difference between starting setpoint value and actual measured value and to correct the at least one stored starting limiting value by this difference.

7. The safety workbench according to claim 1, wherein the at least one starting limiting value is a fraction of the maximum fan performance.

8. The safety workbench according to claim 1, wherein the device control unit is implemented to cause the at least one measurement device to ascertain an actual measured value for a normal fan performance.

9. The safety workbench according to claim 1, wherein an upper starting limiting value, which deviates upward by a predefined amount from the starting setpoint value, and a lower starting limiting value, which deviates downward by a predefined amount from the starting setpoint value, are stored in the storage unit.

10. The safety workbench according to claim 9, wherein the safety workbench is implemented to perform a correction separately for each of the starting limiting values to ascertain an upper and a lower actual limiting measured value and to store the corrected limiting values in the storage unit.

11. The safety workbench according claim 1, wherein the safety workbench has multiple fans including an exhaust air fan and a circulating air fan and the safety workbench is implemented to perform a calibration separately for each of the fans.

12. The safety workbench according to claim 1, wherein the safety workbench has a safety monitoring system, which outputs a visual and/or acoustic alarm, if the analysis unit establishes a deviation out of the range which is fixed by actual measured value and corrected limiting value or corrected upper and corrected lower limiting value.

* * * * *